US011426634B2

(12) United States Patent
Sajima et al.

(10) Patent No.: US 11,426,634 B2
(45) Date of Patent: Aug. 30, 2022

(54) GOLF BALL

(71) Applicant: Sumitomo Rubber Industries, Ltd., Hyogo (JP)

(72) Inventors: Takahiro Sajima, Kobe (JP); Toshiyuki Takubo, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/702,043

(22) Filed: Dec. 3, 2019

(65) Prior Publication Data

US 2020/0197752 A1 Jun. 25, 2020

(30) Foreign Application Priority Data

Dec. 19, 2018 (JP) ..... JP2018-237054

(51) Int. Cl.
*A63B 37/12* (2006.01)
*A63B 37/00* (2006.01)

(52) U.S. Cl.
CPC ..... *A63B 37/0007* (2013.01); *A63B 37/0012* (2013.01); *A63B 37/0056* (2013.01); *A63B 37/0064* (2013.01); *A63B 37/0075* (2013.01)

(58) Field of Classification Search
CPC ..... A63B 37/0007; A63B 37/0009
USPC ..... 473/383
See application file for complete search history.

(56) References Cited

U.S. PATENT DOCUMENTS

| | | | | |
|---|---|---|---|---|
| D107,066 | S * | 11/1937 | Cavignac | D21/708 |
| 4,830,378 | A * | 5/1989 | Aoyama | A63B 37/0004 473/383 |
| 6,905,426 | B2 * | 6/2005 | Morgan | A63B 37/0004 473/383 |
| 7,128,666 | B2 * | 10/2006 | Veilleux | A63B 37/0004 473/384 |
| 7,198,578 | B2 * | 4/2007 | Simonds | A63B 37/0003 473/378 |
| 2021/0197029 | A1 * | 7/2021 | Beratlis | A63B 37/008 |

FOREIGN PATENT DOCUMENTS

JP 2005-185341 A 7/2005

* cited by examiner

*Primary Examiner* — Raeann Gorden
(74) *Attorney, Agent, or Firm* — Studebaker & Brackett PC

(57) ABSTRACT

A golf ball according to an aspect of the present invention is a golf ball having a large number of dimples, a surface of the golf ball is covered with a plurality of virtual flat surfaces each having a triangular shape, one or more dimples are arranged so as to correspond to each of the virtual flat surfaces, and an edge of each dimple is formed in a linear shape. Each dimple may have a triangular pyramid shape or a triangular frustum shape.

12 Claims, 7 Drawing Sheets

GOLF BALL

This application claims priority to and the benefit of Japanese Patent Application No. 2018-237054, filed on Dec. 19, 2018, the entire disclosure of which is incorporated herein by reference.

BACKGROUND OF THE INVENTION

Field of the Invention

The present invention relates to golf balls. Specifically, the present invention relates to golf balls having dimples on the surfaces thereof.

Description of the Related Art

Golf balls have a large number of dimples on the surfaces thereof. The dimples disturb the air flow around the golf ball during flight to cause turbulent flow separation. This phenomenon is referred to as "turbulization". Due to turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect". Excellent dimples efficiently disturb the air flow. Excellent dimples produce a long flight distance.

Although the edges (contours) of dimples are generally circular, JP2005-185341 (Patent Literature 1) discloses a golf ball having dimples with polygonal edges. Patent Literature 1 states that, by making the edges of dimples to have polygonal shapes, the occupation ratio of the dimples to the entire surface of the golf ball can be increased, and the air resistance during flight can be reduced, resulting in a sufficient flight distance. The edges of the dimples disclosed in Patent Literature 1 are polygonal, but each side of the edges is formed in a curved shape.

SUMMARY OF THE INVENTION

Meanwhile, a relatively weak golf player such as a woman, an elderly person, or the like has a low head speed, and thus their ball speed is low. If the ball speed is low as described above, due to an attempt to obtain a larger flight distance, the launch angle of a golf ball tends to increase and the spin rate tends to increase. As a result, the trajectory becomes excessively high, and the flight distance is not extended.

The aforementioned golf ball having dimples with polygonal edges has excellent design and aerodynamic characteristics, but the characteristics of balls hit by each golf player, particularly, the flight distances of relatively weak golf players, have not been sufficiently studied.

An object of the present invention is to provide a golf ball that has excellent design and that can extend the flight distance of a relatively weak golf player.

A golf ball according to an aspect of the present invention is a golf ball having a large number of dimples, a surface of the golf ball is covered with a plurality of virtual flat surfaces each having a triangular shape, one or more dimples are arranged so as to correspond to each of the virtual flat surfaces, and an edge of each dimple is formed in a linear shape.

In the golf ball, since the edge of each dimple is formed in a linear shape, an impression that the entire golf ball looks like a linearly cut jewel is given to a viewer, and the golf ball has excellent design. In addition, as compared to the case where the edge of each dimple is formed in a curved shape, the lift force that acts on the golf ball is reduced, while the drag is reduced. Thus, the flight distance of a relatively weak golf player whose trajectory tends to be higher can be particularly extended.

In the above golf ball, each dimple has a triangular pyramid shape or a triangular frustum shape.

When each dimple has a triangular pyramid shape or a triangular frustum shape as described above, valley lines (portions corresponding to the lateral sides of the triangular pyramid or the triangular frustum) are formed on the dimple, so that the design can be further improved also owing to the fact that the edges of the dimples are linear.

In the above golf ball, vertices of the virtual flat surfaces may be located on a surface of a phantom sphere of the golf ball.

According to this configuration, the golf ball is close to a sphere and thus easily rolls. As a result, the run of the golf ball which is the distance from a landing point to a stopping point is increased, and the flight distance of the golf ball is extended.

In the above golf ball, a ratio of a difference (V1−V2) between a volume V1 of a phantom sphere of the golf ball and a volume V2 of the golf ball to the volume V1 of the phantom sphere of the golf ball may be greater than or equal to 2% and less than or equal to 14%.

According to this configuration, the trajectory of the golf ball during flight is optimized. That is, excessive dropping or rising of the golf ball during flight can be prevented.

In the above golf ball, the virtual flat surfaces may be faces of a geodesic polyhedron inscribed in a phantom sphere of the golf ball.

A geodesic polyhedron is formed by a large number of triangles having nearly equal areas. Therefore, according to the above configuration, the large number of dimples can be uniformly arranged on the surface of the golf ball.

In the above golf ball, the edge of each dimple may have a triangular shape, and sides of a triangle formed by edges of one or more dimples may coincide with a contour of a face of the geodesic polyhedron.

According to this configuration, the respective dimples can be formed so as to have similar sizes and similar shapes. That is, dimples having similar sizes and shapes can be uniformly arranged on the surface of the golf ball.

In the above golf ball, sides of a triangle formed by edges of four dimples may coincide with a contour of a face of a geodesic 80-faced polyhedron inscribed in the phantom sphere of the golf ball.

According to this configuration, 320 dimples can be formed on the surface of the golf ball. Accordingly, an appropriate number of dimples are formed on the surface of the golf ball, so that a sufficient flight distance can be ensured. The number of dimples with which a sufficient flight distance can be ensured is not less than 150 and not greater than 600.

In the above golf ball, sides of a triangle formed by edges of two dimples may coincide with a contour of a face of a geodesic 180-faced polyhedron inscribed in the phantom sphere of the golf ball.

According to this configuration, 360 dimples can be formed on the surface of the golf ball. Accordingly, an appropriate number of dimples are formed on the surface of the golf ball, so that a sufficient flight distance can be ensured.

In the above golf ball, sides of a triangle formed by an edge of one dimple may coincide with a contour of a face of a geodesic 320-faced polyhedron inscribed in the phantom sphere of the golf ball.

According to this configuration, 320 dimples can be formed on the surface of the golf ball. Accordingly, an appropriate number of dimples are formed on the surface of the golf ball, so that a sufficient flight distance can be ensured.

According to this configuration, it is possible to provide a golf ball that has excellent design and that can extend the flight distance of a relatively weak golf player.

DESCRIPTION OF THE PREFERRED EMBODIMENTS

The following will describe in detail the present invention based on preferred embodiments with appropriate reference to the drawings.

First Embodiment

First, a golf ball 2 according to a first embodiment will be described. In the following, the structure of the golf ball 2 will be described, and then the shapes and the arrangement of dimples 10 will be described.

<Structure of Golf Ball>

Figure 1:
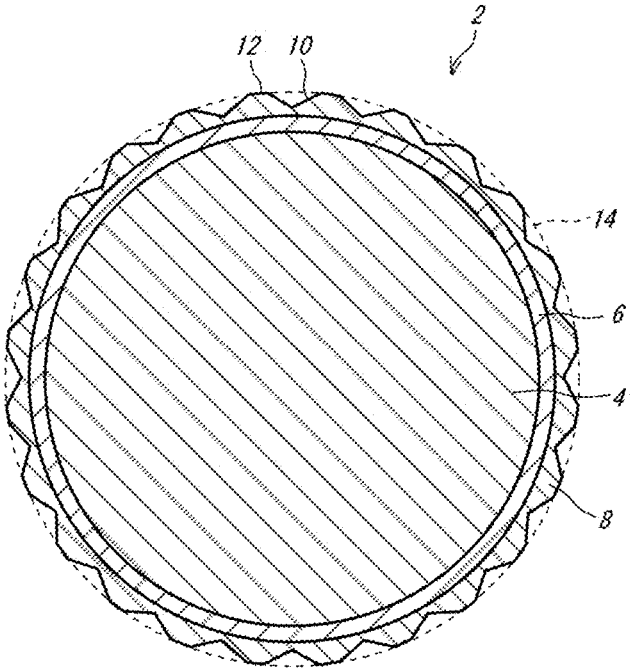
FIG. 1 is a schematic cross-sectional view of a golf ball according to a first embodiment.

FIG. 1 is a schematic cross-sectional view of the golf ball 2 according to the first embodiment. As shown in FIG. 1, the golf ball 2 according to the present embodiment includes a spherical core 4, a mid layer 6 positioned outside the core 4, and a cover 8 positioned outside the mid layer 6. The golf ball 2 has a large number of dimples 10 on the surface thereof. Of the surface of the golf ball 2, a part other than the dimples 10 is a land 12. The golf ball 2 includes a paint layer and a mark layer on the external side of the cover 8, but these layers are not shown in the drawing.

The golf ball 2 preferably has a diameter of not less than 40 mm and not greater than 45 mm. From the viewpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The golf ball 2 according to the present embodiment has a diameter of 42.7 mm.

The golf ball 2 preferably has a weight of not less than 40 g and not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

The core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferable, and high-cis polybutadienes are particularly preferable.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, and a dispersant. The rubber composition may include a carboxylic acid or a carboxylate. The rubber composition may include synthetic resin powder or cross-linked rubber powder.

The core 4 has a diameter of preferably not less than 30.0 mm and particularly preferably not less than 38.0 mm. The diameter of the core 4 is preferably not greater than 42.0 mm and particularly preferably not greater than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

The resin composition of the mid layer 6 may include another polymer instead of an ionomer resin or together with an ionomer resin. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably not less than 0.2 mm and particularly preferably not less than 0.3 mm. The thickness of the mid layer 6 is preferably not greater than 2.5 mm and particularly preferably not greater than 2.2 mm. The mid layer 6 has a specific gravity of preferably not less than 0.90 and particularly preferably not less than 0.95. The specific gravity of the mid layer 6 is preferably not greater than 1.10 and particularly preferably not greater than 1.05. The mid layer 6 may have two or more layers.

The cover 8 is formed from a resin composition. Preferably, the cover 8 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 having the cover 8 that includes an ionomer resin has excellent resilience performance. The golf ball 2 has an excellent flight distance upon a shot with a driver. The ionomer resin described above for the mid layer 6 can be used for the cover 8.

An ionomer resin and another resin may be used in combination. In this case, in light of resilience performance, the ionomer resin is included as the principal component of the base polymer. The proportion of the ionomer resin to the entire base polymer is preferably not less than 50% by weight, more preferably not less than 70% by weight, and particularly preferably not less than 80% by weight.

The resin composition of the cover 8 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

The cover 8 has a thickness of preferably not less than 0.2 mm and particularly preferably not less than 0.3 mm. The thickness of the cover 8 is preferably not greater than 2.5 mm and particularly preferably not greater than 2.2 mm. The cover 8 has a specific gravity of preferably not less than 0.90 and particularly preferably not less than 0.95. The specific gravity of the cover 8 is preferably not greater than 1.10 and particularly preferably not greater than 1.05. The cover 8 may have two or more layers.

In FIG. 1, a phantom sphere 14 of the golf ball 2 is shown by a broken line. The phantom sphere 14 is a sphere in which the golf ball 2 is inscribed. That is, the diameter of the phantom sphere 14 is equal to the diameter of the golf ball 2.

<Shapes and Arrangement of Dimples>

Figure 2:
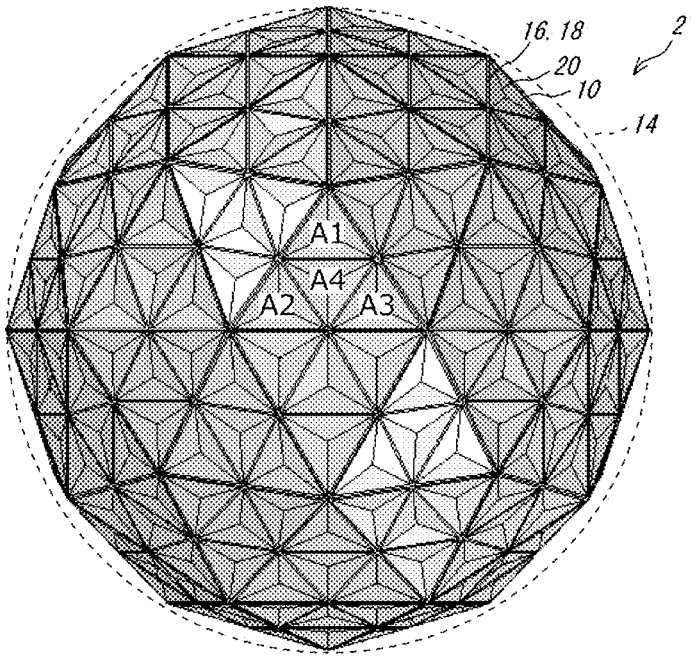
FIG. 2 is a diagram showing the golf ball according to the first embodiment.

FIG. 2 is a diagram showing the golf ball 2 according to the first embodiment. As described above, the golf ball 2 has a large number of dimples 10 on the surface thereof. The dimples 10 are recessed toward the center side of the golf ball 2 and are open toward the outside of the golf ball 2. The dimples 10 are adjacent to each other, and edge lines 16 are formed at boundary portions between the dimples 10. The edge lines 16 correspond to the land 12 shown in FIG. 1. The edge lines 16 constitute an edge 18 of each dimple 10 and form the outline (contour) of the opening portion of each dimple 10.

In the present embodiment, each edge line 16 has a predetermined width. From the viewpoint of effectively improving aerodynamic characteristics, the width of each edge line 16 is preferably not greater than 0.5 mm, more preferably not greater than 0.4 mm, and particularly preferably not greater than 0.3 mm. From the viewpoint of easy production, the width of each edge line 16 is preferably not less than 0.02 mm. Moreover, the length of each edge line 16 is preferably not less than 3 mm and not greater than 16 mm, more preferably not less than 4 mm and not greater than 15 mm, and particularly preferably not less than 5 mm and not greater than 14 mm. When the edge line 16 is shown in an enlarged manner, the surface of the edge line 16 is desirably flat, and both ends in the width direction of the edge line 16 are desirably so-called sharp edges (that is, not excessively chamfered).

As shown in FIG. 2, the edge 18 of each dimple 10 has a triangular shape. A portion corresponding to each side of the triangle of the edge 18 of each dimple 10 is formed in a linear shape. The term "linear shape" means a linear shape as viewed from the radial direction of the golf ball 2 and a linear shape in a cross-sectional view taken along the direction in which the edge 18 extends.

Each dimple 10 has a triangular pyramid shape in which a portion surrounded by the edge 18, that is, the opening portion, is a bottom surface. Each dimple 10 may have a triangular frustum shape. Accordingly, each dimple 10 has linear valley lines 20 (portions corresponding to the lateral sides of the triangular pyramid or the triangular frustum) on the inner surface thereof. As described above, in the present embodiment, since the portions corresponding to the sides of the triangle of the edge 18 of each dimple 10 are linear, and the linear valley lines 20 are formed on the inner surface of each dimple 10, an impression that the entire golf ball 2 looks like a linearly cut jewel is given to a viewer, and the golf ball 2 has excellent design.

From the viewpoint of effectively improving aerodynamic characteristics, the width of each valley line 20 is preferably not greater than 0.5 mm, more preferably not greater than 0.4 mm, and particularly preferably not greater than 0.3 mm. Moreover, the length of each valley line 20 is preferably not less than 3 mm and not greater than 16 mm, more preferably not less than 4 mm and not greater than 15 mm, and particularly preferably not less than 5 mm and not greater than 14 mm.

Figure 3:
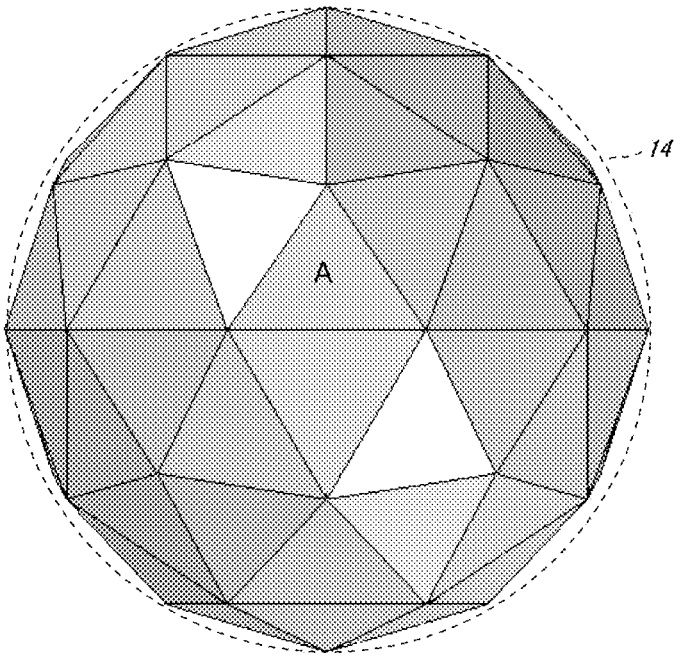
FIG. 3 is a diagram showing a geodesic 80-faced polyhedron.

In the present embodiment, the dimples 10 are arranged on the basis of a geodesic polyhedron that is inscribed in the phantom sphere 14 of the golf ball 2. FIG. 3 is a diagram showing a geodesic 80-faced polyhedron that is one geodesic polyhedron. A geodesic polyhedron refers to a polyhedron formed by dividing each face of a regular polyhedron such as a regular icosahedron or the like into smaller triangles close to regular triangles and arranging the vertices of the smaller triangles on the same sphere. The geodesic 80-faced polyhedron shown in FIG. 3 is a geodesic polyhedron obtained by dividing each face of a regular icosahedron into four smaller triangles.

In the present embodiment, each face of the geodesic 80-faced polyhedron is further divided into four triangles, and dimples 10 are arranged so as to correspond to the respective four triangles. For example, when attention is focused on one face of the geodesic 80-faced polyhedron indicated by reference character A in FIG. 3, the face indicated by reference character A is divided into four triangles, and dimples arranged so as to correspond to the respective four triangles are dimples 10 indicated by reference characters A1 to A4 in FIG. 2. The edges 18 of the above four dimples 10 are located on the same plane.

As described above, in the present embodiment, each dimple 10 is arranged such that the sides of the triangles into which each face of the geodesic 80-faced polyhedron is divided coincide with the edges 18 of the dimples 10. In other words, the edges 18 of four dimples 10 (in the above example, the dimples 10 indicated by reference characters A1 to A4) form one large triangle, and the sides of the triangle coincide with the contour of a face of the geodesic 80-faced polyhedron (in the above example, the face indicated by reference character A). A geodesic polyhedron is formed by a large number of triangles having nearly equal areas. Therefore, according to the present embodiment, the large number of dimples 10 can be uniformly arranged on the surface of the golf ball 2.

In the present embodiment, since the dimples 10 are arranged as described above, 320 dimples 10 can be formed on the surface of the golf ball 2. Accordingly, an appropriate number of dimples 10 are formed on the surface of the golf ball 2, so that a sufficient flight distance can be ensured. The number of dimples 10 with which a sufficient flight distance can be ensured is not less than 150 and not greater than 600.

In the present embodiment, each face of the geodesic 80-faced polyhedron is divided such that triangles (in the above example, the triangles corresponding to reference characters A1 to A3) are formed so as to correspond to the three vertices of the face of the geodesic 80-faced polyhedron, respectively, and the remaining one triangle (in the above example, the triangle corresponding to reference character A4) is formed between these triangles. By dividing so, also owing to the fact that each dimple 10 has a triangular pyramid shape, that is, the valley lines 20 are formed on each dimple 10, a star-shaped pattern is formed on the surface of the golf ball 2. As a result, the design of the golf ball 2 can be further improved.

As described above, the vertices of each face of the geodesic 80-faced polyhedron are located on the surface of the phantom sphere 14 of the golf ball 2. Thus, portions, of the edges 18 of the dimples 10, corresponding to the vertices of the respective faces of the geodesic 80-faced polyhedron are located on the surface of the phantom sphere 14 of the golf ball 2. That is, some of portions corresponding to the vertices of the triangles of the edges 18 of the dimples 10 are located on the surface of the phantom sphere 14 of the golf ball 2. Accordingly, the golf ball 2 has a shape close to a spherical shape and easily rolls. As a result, the run of the golf ball 2 which is the distance from a landing point to a stopping point is increased, and the flight distance of the golf ball 2 is extended.

In the present embodiment, when the difference between the volume V1 of the phantom sphere 14 of the golf ball 2 and the volume V2 of the golf ball 2 is defined as a difference volume ΔV (V1−V2), the dimples 10 are formed such that the ratio (ΔV/V1×100) of the difference volume ΔV to the volume V1 of the phantom sphere 14 of the golf ball 2 is not less than 2% and not greater than 14%. When the ratio of the difference volume ΔV to the volume V1 of the phantom sphere 14 of the golf ball 2 is not less than 2% and not greater than 14%, the trajectory of the golf ball 2 during flight is optimized. That is, excessive dropping or rising of the golf ball 2 during flight can be prevented. From the viewpoint of the trajectory optimization, the ratio of the difference volume ΔV to the volume V1 of the phantom sphere 14 of the golf ball 2 is more preferably not less than 2.5% and not greater than 13.5%, and particularly preferably not less than 3% and not greater than 13%.

Second Embodiment

Next, a golf ball 22 according to a second embodiment will be described. The golf ball 22 according to the second embodiment is different from the golf ball 2 according to the first embodiment in the arrangement of dimples 10. For the other points, the golf ball 22 according to the second embodiment basically has the same structure as the golf ball 2 according to the first embodiment. In the following, the golf ball 22 according to the present embodiment will be described mainly for the arrangement of the dimples 10, and the description of points in common with the golf ball 2 according to the first embodiment is omitted.

Figure 4:
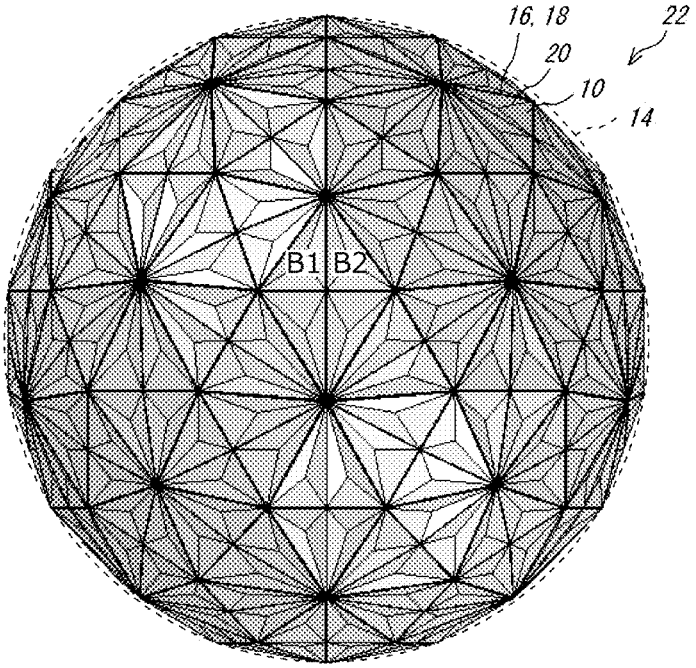
FIG. 4 is a diagram showing a golf ball according to a second embodiment.
Figure 5:
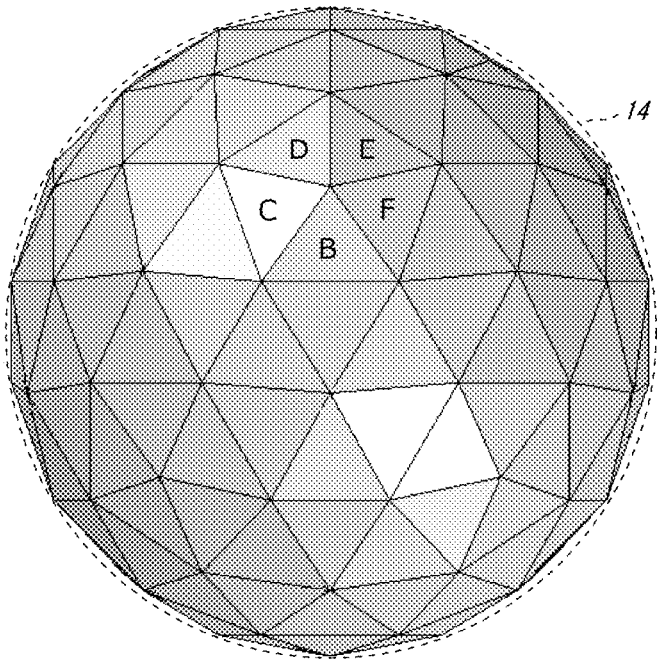
FIG. 5 is a diagram showing a geodesic 180-faced polyhedron.

FIG. 4 is a diagram showing the golf ball 22 according to the second embodiment. In the present embodiment as well, the edge 18 of each dimple 10 has a triangular shape, and a portion corresponding to each side of the triangle of the edge 18 is formed in a linear shape. In addition, each dimple 10 has a triangular pyramid shape. The dimples 10 of the present embodiment are arranged on the basis of a geodesic "180-faced polyhedron" inscribed in the phantom sphere 14 of the golf ball 22, not on the basis of a geodesic "80-faced polyhedron" inscribed in the phantom sphere 14 of the golf ball 22. FIG. 5 is a diagram showing the geodesic 180-faced polyhedron. The geodesic 180-faced polyhedron is a geodesic polyhedron obtained by dividing each face of a regular icosahedron into 9 smaller triangles.

In the present embodiment, each face of the geodesic 180-faced polyhedron is further divided into two triangles, and dimples 10 are arranged so as to correspond to the respective two triangles. For example, when attention is focused on one face of the geodesic 180-faced polyhedron indicated by reference character B in FIG. 5, the face indicated by reference character B is divided into two triangles, and dimples arranged so as to correspond to the respective two triangles are dimples 10 indicated by reference characters B1 and B2 in FIG. 4. The edges 18 of the above two dimples 10 are located on the same plane.

As described above, in the present embodiment, each dimple 10 is arranged such that the sides of the triangles into which each face of the geodesic 180-faced polyhedron is divided coincide with the edges 18 of the dimples 10. In other words, the edges 18 of two dimples 10 (in the above example, the dimples 10 indicated by reference characters B1 and B2) form one triangle, and the sides of the triangle coincide with the contour of a face of the geodesic 180-faced polyhedron (in the above example, the face indicated by reference character B). In the present embodiment, since the dimples 10 are arranged as described above, the golf ball 22 has 360 dimples 10. Accordingly, an appropriate number of dimples 10 are formed on the surface of the golf ball 22, so that a sufficient flight distance can be ensured.

In the present embodiment, each face of the geodesic 180-faced polyhedron is divided such that two right-angled triangles that are symmetrical (in the above example, the triangles corresponding to reference characters B1 and B2) are formed. Furthermore, each face of the geodesic 180-faced polyhedron is divided such that: the respective faces forming the geodesic 180-faced polyhedron are divided into groups each including five faces with a common vertex (for example, a group of faces indicated by reference characters B to F in FIG. 5); and an edge line 16 that is a boundary portion between the above two right-angled triangles radially extends from the common vertex in each group. By dividing so, also owing to the fact that each dimple 10 has a triangular pyramid shape, that is, the valley lines 20 are formed on each dimple 10, a star-shaped pattern is formed on the surface of the golf ball 22.

As described above, the vertices of each face of the geodesic 180-faced polyhedron are located on the surface of the phantom sphere 14 of the golf ball 22. Thus, portions, of the edges 18 of the dimples 10, corresponding to the vertices of the respective faces of the geodesic 180-faced polyhedron are located on the surface of the phantom sphere 14 of the golf ball 22. That is, some of portions corresponding to the vertices of the triangles of the edges 18 of the dimples 10 are located on the surface of the phantom sphere 14 of the golf ball 22. Furthermore, in the present embodiment, the dimples 10 are arranged on the basis of the geodesic 180-faced polyhedron having a larger number of faces than a geodesic 80-faced polyhedron. Thus, the golf ball 22 can be made closer to a sphere.

Third Embodiment

Next, a golf ball 32 according to a third embodiment will be described. The golf ball 32 according to the third embodiment is different from the golf ball 2 according to the first embodiment in the arrangement of dimples 10. For the other points, the golf ball 32 according to the third embodiment basically has the same structure as the golf ball 2 according to the first embodiment. In the following, the golf ball 32 according to the present embodiment will be described mainly for the arrangement of the dimples 10, and the description of points in common with the golf ball 2 according to the first embodiment is omitted.

Figure 6:
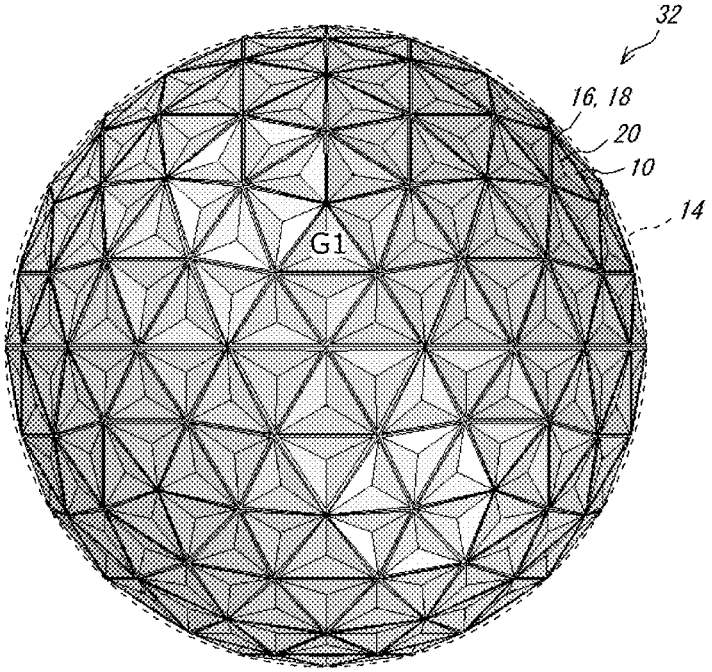
FIG. 6 is a diagram showing a golf ball according to a third embodiment.
Figure 7:
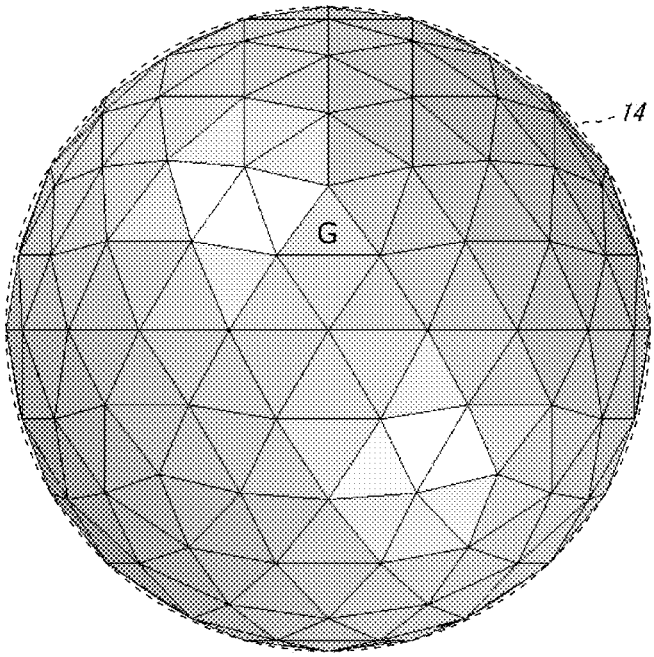
FIG. 7 is a diagram showing a geodesic 320-faced polyhedron.

FIG. 6 is a diagram showing the golf ball 32 according to the third embodiment. In the present embodiment as well, the edge 18 of each dimple 10 has a triangular shape, and a portion corresponding to each side of the triangle of the edge 18 is formed in a linear shape. In addition, each dimple 10 has a triangular pyramid shape. The dimples 10 of the present embodiment are arranged on the basis of a geodesic "320-faced polyhedron" inscribed in the phantom sphere 14 of the golf ball 32, not on the basis of a geodesic "80-faced polyhedron" or a geodesic "180-faced polyhedron" inscribed in the phantom sphere 14 of the golf ball 32. FIG. 7 is a diagram showing the geodesic 320-faced polyhedron. The geodesic 320-faced polyhedron is a geodesic polyhedron obtained by dividing each face of a regular icosahedron into 16 smaller triangles.

In the present embodiment, the dimples 10 are arranged so as to correspond to the respective faces of the geodesic 320-faced polyhedron. For example, when attention is focused on one face of the geodesic 320-faced polyhedron indicated by reference character G in FIG. 7, a dimple arranged so as to correspond to this face is a dimple 10 indicated by reference character G1 in FIG. 6.

As described above, in the present embodiment, each dimple 10 is arranged such that the sides of each face of the geodesic 320-faced polyhedron coincide with the edge 18 of the dimple 10. In other words, the edge 18 of one dimple 10 (in the above example, the dimple 10 indicated by reference character G1) forms one triangle, and the sides of the triangle coincide with the contour of a face of the geodesic 320-faced polyhedron (in the above example, the face indicated by reference character G). In the present embodiment, since the dimples 10 are arranged as described above, the golf ball 32 has 320 dimples 10. Accordingly, an appropriate number of dimples 10 are formed on the surface of the golf ball 32, so that a sufficient flight distance can be ensured.

In the present embodiment, by arranging the dimples 10 as described above, also owing to the fact that each dimple 10 has a triangular pyramid shape, that is, the valley lines 20 are formed on each dimple 10, a star-shaped pattern is formed on the surface of the golf ball 32.

As described above, the vertices of each face of the geodesic 320-faced polyhedron are located on the surface of the phantom sphere 14 of the golf ball 32. Thus, portions, of the edges 18 of the dimples 10, corresponding to the vertices of the respective faces of the geodesic 320-faced polyhedron, that is, portions corresponding to the vertices of the triangles of the edges 18 of the dimples 10, are all located on the surface of the phantom sphere 14 of the golf ball 32. Thus, in the present embodiment, the golf ball 32 can be made closer to a sphere.

In each of the first to third embodiments described above, each face of the geodesic polyhedron inscribed in the golf ball is used as a virtual flat surface, and one or more dimples are arranged so as to correspond to the virtual flat surface. The virtual flat surface only needs to be a surface covering the golf ball, and may be a surface other than a face of a geodesic polyhedron. In addition, the edge of each dimple has a triangular shape, but may have a polygonal shape other than a triangular shape, and, for example, may have a shape such as a star shape or the like.

EXAMPLES

The following will show the effects of the present invention by means of Examples, but the present invention should not be construed in a limited manner on the basis of the description of these Examples.

Example 1

A rubber composition was obtained by kneading 100 parts by weight of a high-cis polybutadiene (trade name "BR-730", manufactured by JSR Corporation), 27.4 parts by weight of zinc diacrylate, 5 parts by weight of zinc oxide, an appropriate amount of barium sulfate, 0.5 parts by weight of diphenyl disulfide, and 0.9 parts by weight of dicumyl peroxide. This rubber composition was placed into a mold including upper and lower mold halves each having a hemispherical cavity, and heated at 160° C. for 20 minutes to obtain a core with a diameter of 38.20 mm. The amount of barium sulfate was adjusted such that a core having a predetermined weight was obtained.

A resin composition was obtained by kneading 26 parts by weight of an ionomer resin (trade name "Himilan AM7337", manufactured by Du Pont-MITSUI POLYCHEMICALS Co., Ltd.), 26 parts by weight of another ionomer resin (trade name "Himilan AM7329", manufactured by Du Pont-MITSUI POLYCHEMICALS Co., Ltd.), 48 parts by weight of a styrene block-containing thermoplastic elastomer (trade name "Rabalon T3221C", manufactured by Mitsubishi Chemical Corporation), 4 parts by weight of titanium dioxide (A220), and 0.2 parts by weight of a light stabilizer (trade name "JF-90", manufactured by Johoku Chemical Co., Ltd.) with a twin-screw kneading extruder. The core was covered with this resin composition by injection molding to form a mid layer. The thickness of the mid layer was 1.00 mm.

A resin composition was obtained by kneading 47 parts by weight of an ionomer resin (trade name "Himilan 1555", manufactured by Du Pont-MITSUI POLYCHEMICALS Co., Ltd.), 46 parts by weight of another ionomer resin (trade name "Himilan 1557", manufactured by Du Pont-MITSUI POLYCHEMICALS Co., Ltd.), 7 parts by weight of a styrene block-containing thermoplastic elastomer (the aforementioned "Rabalon T3221C"), 4 parts by weight of titanium dioxide (A220), and 0.2 parts by weight of a light stabilizer (the aforementioned "JF-90") with a twin-screw kneading extruder. The sphere consisting of the core and the mid layer was placed into a final mold having a large number of pimples on its cavity face. The mid layer was covered with the resin composition by injection molding to form a cover. The thickness of the cover was 1.25 mm. Dimples having a shape that is the inverted shape of the pimples were formed on the cover.

A clear paint including a two-component curing type polyurethane as a base material was applied to this cover to obtain a golf ball of Example 1 with a diameter of about 42.7 mm and a weight of about 45.6 g. The golf ball corresponds to the golf ball 2 according to the first embodiment described above, and the specifications thereof are as shown in Table 1.

Examples 2 to 5 and Comparative Example 1

Golf balls of Examples 2 to 5 and Comparative Example 1 were obtained in the same manner as Example 1, except the final mold was changed and except for the shapes and the arrangement of the dimples. The golf ball of Example 2 corresponds to the golf ball 22 according to the second embodiment described above. Each of the golf balls of Examples 3 to 5 corresponds to the golf ball 32 according to the third embodiment, and the edge lines 16 and the valley lines 20 are formed in the same manner, except that the degrees of fillets (roundness at corner portions) in the edge lines 16 and the valley lines 20 are different. The specifications of the golf balls of Examples 2 to 5 and Comparative Example 1 are as shown in Table 1.

(Flight Test)

Here, assuming female and relatively old players, performance evaluation was performed as follows. A driver (trade name "XXIO 10", manufactured by Sumitomo Rubber Industries, Ltd., shaft hardness: R, loft angle: 10.5°) was attached to a swing machine manufactured by Golf Laboratories, Inc. A golf ball was hit under the condition of a head speed of 32.5 m/sec, and the flight distance which is the sum of the carry and the run was measured. Similarly, a 7-iron (trade name "XXIO 10", manufactured by Sumitomo Rubber Industries, Ltd., shaft hardness: R, loft angle: 29°) was attached to the swing machine manufactured by Golf Laboratories, Inc. A golf ball was hit under the condition of a head speed of 27 m/sec, and the flight distance which is the sum of the carry and the run was measured. During the test, the weather was almost windless. The average value of data obtained by 20 measurements is shown in Table 1.

As shown in Table 1, the golf ball of each Example has excellent flight performance upon a shot with a driver and upon a shot with an iron when a head speed is relatively low (the head speed of an average golf player is 40 m/sec). From the evaluation results, advantages of the present invention are clear. That is, advantages of the present invention are clear in extending the flight distance of a relatively weak golf player.

What is claimed is:

1. A golf ball having a large number of dimples, wherein
a surface of the golf ball has a plurality of edges forming a plurality of triangular shapes, the plurality of triangular shapes being planar with each other,
a plurality of dimples are arranged so as to correspond to a respective each of the plurality of the edges, and
the each of the plurality of the edges of the plurality of dimples is straight, and is not contoured along a spherical shape of the ball.

2. The golf ball according to claim 1, wherein each dimple has a triangular pyramid shape or a triangular frustum shape.

3. The golf ball according to claim 1, wherein some of the plurality of edges correspond to vertices of the plurality of triangular shapes that are located on a surface of a phantom sphere of the golf ball, the phantom sphere is a sphere in which the golf ball is inscribed.

4. The golf ball according to claim 1, wherein a ratio of a difference (V1−V2) between a volume V1 of a phantom sphere of the golf ball and a volume V2 of the golf ball to the volume V1 of the phantom sphere of the golf ball is not less than 2% and not greater than 14%, the phantom sphere is a sphere in which the golf ball is inscribed.

5. The golf ball according to claim 1, wherein the plurality of the edges are faces of a geodesic polyhedron inscribed in a phantom sphere of the golf ball, the phantom sphere is a sphere in which the golf ball is inscribed.

6. The golf ball according to claim 5, wherein
a triangular shape of the plurality of triangular shapes formed by the plurality of the edges extends around a dimple of the plurality of dimples.

7. The golf ball according to claim 5, wherein the sides of a triangle formed by edges of four dimples coincide with a contour of a face of a geodesic 80-faced polyhedron inscribed in the phantom sphere of the golf ball.

8. The golf ball according to claim 1, wherein each of the plurality of the edges corresponds to a land portion surrounding one or more of the plurality of dimples.

TABLE 1

| | Example 1 | Example 2 | Example 3 | Example 4 | Example 5 | Comparative Example 1 |
|---|---|---|---|---|---|---|
| Shapes of edges of dimples | Triangle | Triangle | Triangle | Triangle | Triangle | Circle |
| Number of faces of geodesic polyhedron as base | 80 | 180 | 320 | 320 | 320 | — |
| Number of dimples per face of geodesic polyhedron | 4 | 2 | 1 | 1 | 1 | — |
| Total number of dimples | 320 | 360 | 320 | 320 | 320 | 338 |
| Lengths of edge lines [mm] | 11.7-13.2 | 7.8-9.1 | 5.9-6.9 | 5.9-6.9 | 5.9-6.9 | — |
| Phantom sphere volume V1 [$mm^3$] | 40,765 | 40,765 | 40,765 | 40,765 | 40,765 | 40,765 |
| Golf ball volume V2 [$mm^3$] | 35,256 | 38,016 | 38,955 | 39,035 | 39,105 | 40,195 |
| Difference volume ΔV (V1 − V2) [$mm^3$] | 5,509 | 2,749 | 1,799 | 1,729 | 1,659 | 570 |
| Difference volume ratio (ΔV/V1 × 100) [%] | 13.5 | 6.7 | 4.4 | 4.2 | 4.1 | 1.4 |
| Flight distance upon driver shot [m] | 151.1 | 151.8 | 151.5 | 152.2 | 150.9 | 150.0 |
| Flight distance upon iron shot [m] | 112.1 | 112.5 | 112.3 | 112.8 | 111.7 | 111.2 |

9. A golf ball having a large number of dimples, wherein a surface of the golf ball has a plurality of edges forming a plurality of triangular shapes, the plurality of triangular shapes being planar with each other, a plurality of dimples are arranged so as to correspond to a respective each of the plurality of the edges, the each of the plurality of the edges of the plurality of dimples is straight, the plurality of the edges are faces of a geodesic polyhedron inscribed in a phantom sphere of the golf ball, the phantom sphere being a sphere in which the golf ball is inscribed, and the sides of a triangle formed by edges of two dimples coincide with a contour of a face of a geodesic 180-faced polyhedron inscribed in the phantom sphere of the golf ball.

10. The golf ball according to claim 9, wherein each of the plurality of the edges corresponds to a land portion surrounding one or more of the plurality of dimples.

11. A golf ball having a large number of dimples, wherein a surface of the golf ball has a plurality of edges forming a plurality of triangular shapes, the plurality of triangular shapes being planar with each other, and a plurality of dimples are arranged so as to correspond to a respective each of the plurality of edges.

12. The golf ball according to claim 11, wherein each of the plurality of the edges corresponds to a land portion surrounding one or more of the plurality of dimples.

* * * * *